United States Patent [19]

Greer et al.

[11] 4,063,373

[45] Dec. 20, 1977

[54] MECHANISM TO RESTRAIN SLAMMING OF SHOVEL DIPPER DOORS

[75] Inventors: Donald J. Greer, Danville, Ill.; John R. Olds, Veedersburg, Ind.

[73] Assignee: Esco Corporation, Portland, Oreg.

[21] Appl. No.: 763,356

[22] Filed: Jan. 28, 1977

[51] Int. Cl.[2] ..... E02F 3/46

[52] U.S. Cl. ..... 37/115; 214/145 R; 214/146 R; 214/146 E; 292/80

[58] Field of Search ..... 37/115–117; 214/143, 145 R, 146 R, 146 E; 292/186, 80–84, 229, 177

[56] References Cited

U.S. PATENT DOCUMENTS

| | | | |
|---|---|---|---|
| 1,511,115 | 10/1924 | Downie | 214/146 R |
| 1,822,338 | 9/1931 | Clemens | 214/146 R |
| 2,561,518 | 7/1951 | Larsen | 214/145 |
| 2,588,657 | 3/1952 | Pitts | 37/115 X |
| 2,722,325 | 11/1955 | Dempster | 214/146 R X |
| 2,735,559 | 2/1956 | Burdick et al. | 214/145 |
| 2,788,907 | 4/1957 | Larsen | 214/145 |
| 2,926,800 | 3/1960 | Larsen et al. | 214/145 |
| 3,210,870 | 10/1965 | Watt | 37/115 X |
| 3,219,213 | 11/1965 | Learmont | 214/146 R |

*Primary Examiner*—E. H. Eickholt

*Attorney, Agent, or Firm*—Tilton, Fallon, Lungmus, Chestnut

[57] ABSTRACT

A mechanism to restrain slamming of shovel dipper doors including a pair of arms connected respectively to the back and door of a shovel dipper and pivotally interconnected together with a Belleville spring loading.

9 Claims, 9 Drawing Figures

MECHANISM TO RESTRAIN SLAMMING OF SHOVEL DIPPER DOORS

BACKGROUND AND SUMMARY OF INVENTION

This invention relates to shovel dippers and, more particularly, to a mechanism for restraining slamming of the dipper door. Power shovels have been employed in earth working for many years, being colloquially known in the early years of this century as "steam shovels". These devices were characterized by a dipper, i.e., a box shaped scoop mounted on the end of a stick which pivoted through a vertical arc. At the top of the arc when the dipper or shovel was filled, the entire device was pivoted to one side and the bottom dump door of the dipper opened to release the carried material into a truck or other means for disposition. Thereafter, the door was swung to closed position and, inasmuch as these were heavy, powerful tools intended for rugged work, considerable force was exerted on the door resulting in a clanging during the closing and latching. This often times resulted in deformation of the door or associated confronting portions of the dipper body with the result that there was a loss of seal and material would drain from the dipper during its sideways movement. This is not only wasteful, but could prove dangerous if someone were under the path of movement.

According to the invention, this undesirable phenomenon (of a clanging closure) is avoided through the use of a novel energy dissipation mechanism which features a Belleville spring. The Belleville spring in this environment requires only initial tightening and will continue to perform satisfactorily during a substantial portion of the life of the mechanism.

Other objects and advantages of the invention may be seen in the details of construction and operation set down in the ensuing specification.

DETAILED DESCRIPTION

The invention is described in conjunction with the accompanying drawing, in which FIG. 1 is an elevational view, partially schematic, of a shovel dipper in which the invention can be used to advantage;

Figure 1:
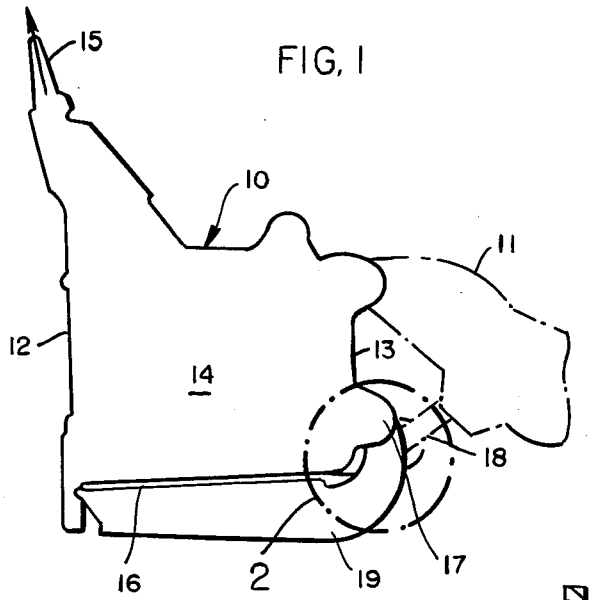

In the illustration given and with reference first to FIG. 1, the numeral 10 designates generally a shovel dipper which is connected to the machine handle or dipper stick 11. The dipper is essentially box-shaped having a front wall 12 interconnected with a back wall 13 and a pair of side walls 14. Usually the front wall at its upper or outer end is provided with a digging edge equipped with a plurality of excavating teeth 15. The dipper top is open while the bottom is openably closed by means of a door 16. The door 16 is pivotally mounted as at 17 on the back wall 13 and means 18 are provided for swinging the door between open and closed positions.

Inasmuch as dippers and the associated mechanism can be made in a variety of ways (see, for example, co-owned U.S. Pat. Nos. 2,543,247; 2,561,518; 2,788,907 and 2,926,800) the foregoing generalized description has been set down only for the sake of establishing a general environment. For additional details of the dipper structure, essentially unrelated to the instant invention, recourse can be made to the just identified patents.

Normally, the door 16 is equipped with heavy, powerful hinge bars 19 which provide the pivotal interconnection with the dipper back 13 as at 17.

Figure 2:
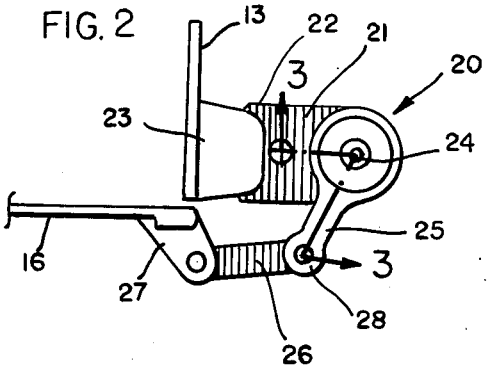
FIG. 2 is a fragmentary elevational view (also partially schematic) of a portion of the dipper of FIG. 1 located within the encircled portion and which illustrates certain of the principal elements of the invention.

Reference is now made to FIG. 2 which is located essentially in the encircled portion of FIG. 1 and which is designated by the numeral 2. In FIG. 2, the energy dissipation mechanism is generally designated by the numeral 20 and is seen to be interconnected between the back wall 13 and the door 16, each of the latter being shown only in fragmentary form. The mechanism 20 includes a first arm 21 which is connected at one end 22 to a projection 23 on the dipper back 13. The connection between the end 22 of the first arm 21 and the projection 23 is a rigid connection and thereby defines a pivot axis 24 adjacent the other end of the first arc 21 (see also FIG. 3). Advantageously, the rigid support is provided by a pair of first arms 21 — again refer to FIG. 3.

Figure 3:
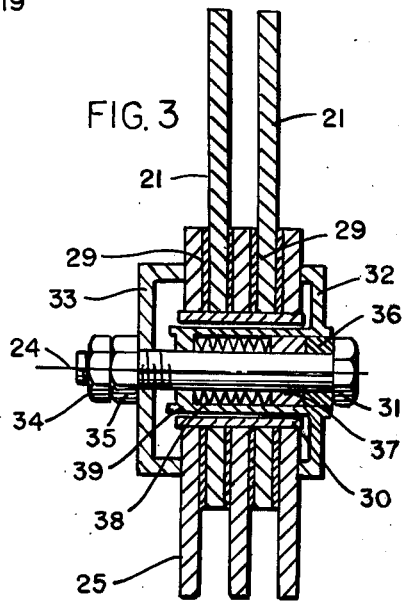
FIG. 3 is an enlarged sectional view taken along the angled sight line 3—3 of FIG. 2.

The mechanism 20 includes a second arm 25 (again referring to FIG. 2) which is connected to the door 16 by means of an actuating link 26. More particularly, the door 16 is equipped with a lug 27 to which is connected one end of the link 26. The other end of the link 26 is pivotally connected to a first end 28 of the second link 25. Reference to FIG. 3 reveals that the second arm 25 includes three parallel arm portions spaced apart so as to straddle the arms 21. A friction liner 29 is interposed between each pair of arms 21 and 25.

As can be appreciated from a comparison of FIGS. 2 and 3, the arms 21 and 25 overlie each other at their second ends, each arm having an opening at the pivot axis 24. More particularly, in the embodiment illustrated, the three arms portions making up the second arm 25 are united by means of anintegral sleeve 30 which is concentric to the pivot axis 24.

Spaced inwardly of the sleeve 30 and coaxial with the pivot axis 24 is a bolt means in the form of a cap screw 31. The cap screw 31 is equipped with a pair of collars 32 and 33 which bear against the portions of the second arm 25.

This is achieved, relative to the left hand portion of FIG. 3 by means of a nut 34 and a jam nut 35 mounted on the cap screw 31 and which bear against the collar 33. At the right hand side of FIG. 3, bearing between the collar 32 and the cap screw 31 is achieved through a jam nut 36, a spacer 37 and a plurality of Belleville springs 38. To accomplish this, the collar 32 is equipped with an integral, central recess as at 39.

Figure 4:
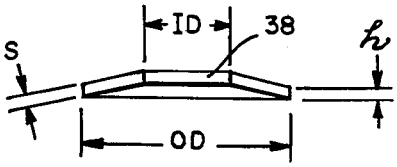
FIG. 4 is a side elevational view of a Belleville spring employed to advantage in the practice of the invention.
Figure 5:
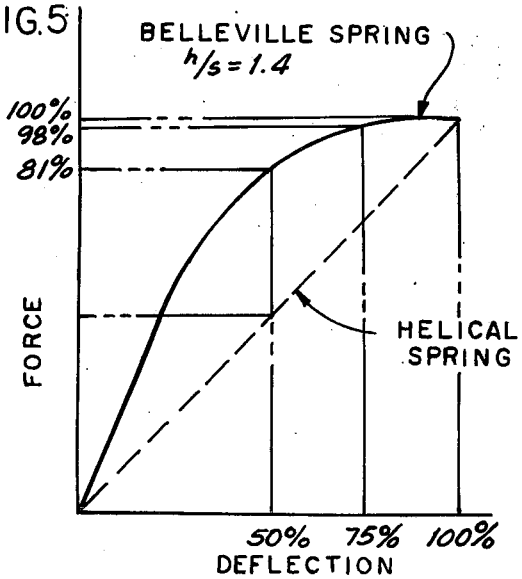
FIG. 5 is a graph plotting force against deflection for a Belleville spring and a conventional helical spring.

Each Belleville spring advantageously takes the form of that shown in FIG. 4. The Belleville spring is a disc which is similar to a washer which has been stamped into a generally conical shape. The Belleville spring exerts a restraining force when flattened. The spring characteristics are dependant upon the proportions of various dimensions or parameters, namely ID, OD thicknesses and dish height h. The ratio of dish height to thickness *h/s* determines the shape of the force deflection curve. A force deflection curve for *h/s* equal to 1.4 is seen in FIG. 5 and it will be noted that the curve has an approximately horizontal portion near the flat condition, i.e., the force remains essentially constant as the deflection varies between 50 and 100%. More particularly, the force drops only to 87% as the deflection is reduced to 50%.

As the mechanism 20 works incident to the various openings and closings of the door 16, the friction liners 29 wear thereby reducing the deflection initially introduced into the Belleville springs by the adjusted tightening of the various nuts on the bolt means 31. However, during a substantial portion of the life of the liners, the restraining force exerted by the Belleville springs 38 remains constant, as can be appreciated from the solid line curve in FIG. 5. This is in studied contrast to the usual helical spring whose force-deflection curve is shown in dotted line in FIG. 5 and wherein the force is proportional to the deflection. It has been found advantageous to proportion the height to thickness ration of the Belleville springs in the range 1.25 to 1.5 so as to provide a restraining force of at least about 75% at a deflection of about 50%.

Figure 7:
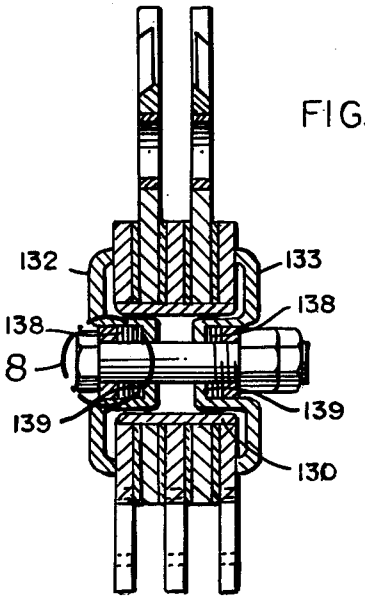
FIG. 7 is a sectional view taken along the angled section line 7—7 of FIG. 6.

Reference is now made to the second sheet of the drawing wherein a modified form of the invention is illustrated. Again, the mechanism 120 includes a first arm 121 which is rigidly connected at the end 122 to the back wall 13 (not shown). Also provided in the same fashion as illustrated in FIG. 2 is a second arm 125 and reference to FIG. 7 reveals that the arm 125 is again made up of three arm portions integrated by means of a sleeve 130. A distinction between the showings in FIGS. 3 and 7 resides in the fact that in FIG. 7 both of the collars 132 and 133 are equipped with central recesses 139 so that Belleville springs 138 can be mounted in each of the recesses 139.

Figure 8:
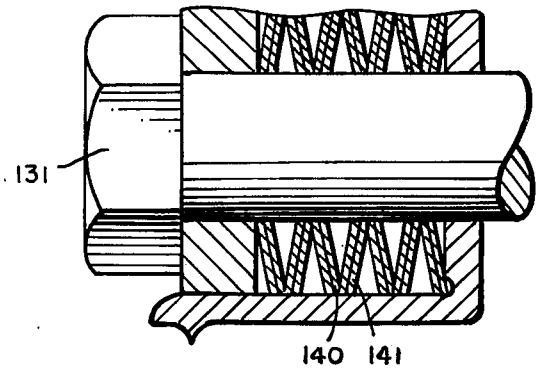
FIG. 8 is an enlarged fragmentary view of the encircled portion of FIG. 7.
Figure 6:
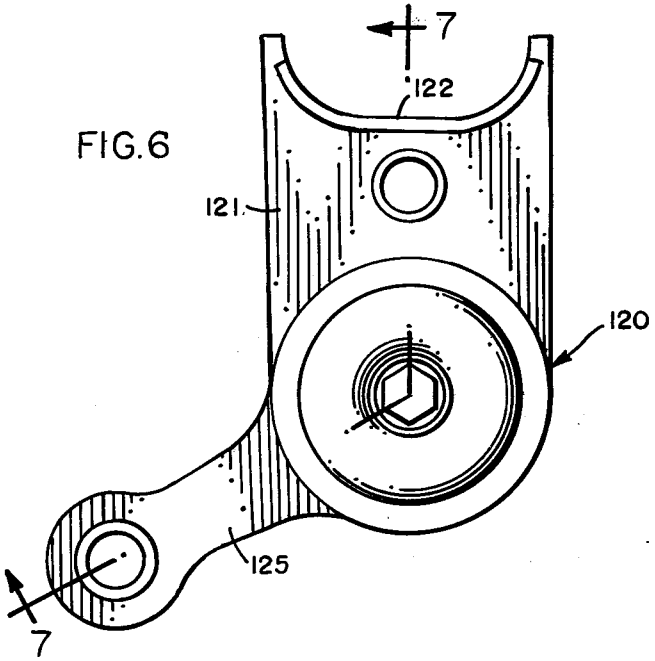
FIG. 6 is a side elevational view of a modified form of mechanism and corresponds essentially to the showing in FIG. 2.

The Belleville spring arrangement is seen in greater detail in FIG. 8. The cap screw 131 is seen to have ensleeved thereon seven sets of Belleville springs with two springs being present in each set. The springs within each set as at 140 are arranged in conforming relation, i.e., are arranged in "parallel".

On the other hand, the springs in adjacent sets are arranged in opposed relation, i.e., in "series" (compare the relationship of the set 141 with the set 140 in FIG. 8).

Figure 9:
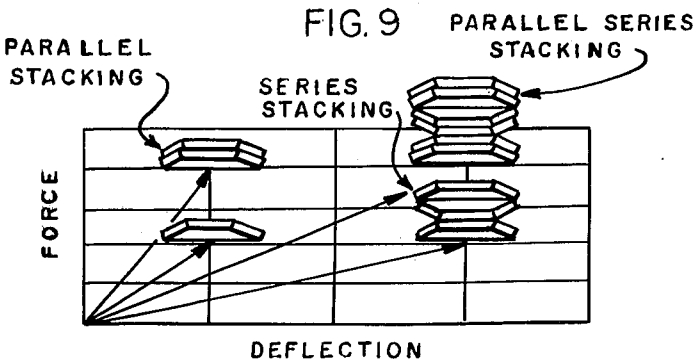
FIG. 9 is a graph showing force-deflection curves for different stacking arrangements.

The difference in the stacking of the Belleville springs is illustrated schematically in FIG. 9 which again is a chart or graph of the forced deflection curves. Series stacking provides a force equal to that of the individual spring but the deflection is that of a single spring multiplied by the number of springs. Parallel stacking has deflection equal to that of the individual spring but the force is that of the single spring multiplied by the number of springs. An intermediate force-deflection relationship is achieved through the use of a series of parallel stacks, i.e., that seen in FIG. 8 which results in the deflection being equal to that of the individual spring multiplied by the number of spring sets while the forces equal to that of the individual spring multiplied by the number of springs within a parallel group. Thus, the FIG. 8 showing has a deflection of seven times the deflection of the individual spring while the force is equal to that of two individual springs.

In any event, the advantage of only initial adjustment is achieved. At the initial installation, the springs are compressed to solid condition. As the mechanism works, the friction liners wear allowing the multiple part spring to relax. However, as indicated above, substantial wear on the friction liners can occur before the restraining force is substantially diminished.

While in the foregoing specification a detailed description of the invention has been set down for the purpose of illustration, many variations in the details hereingiven may be made by those skilled in the art without departing from the spirit and scope of the invention.

I CLAIM:

1. In a shovel dipper having a generally box shape defined by interconnected front, back and side walls and an open top, a door pivotally attached to said back wall, and means operably associated with said dipper for opening and closing said door, the improvement comprising an energy dissipation mechanism to restrain slamming of said door upon closing thereof, said mechanism including a first arm connected at one end thereof to said back wall and a second arm connected at one end thereof to said door, said first and second arms on the other ends thereof being in superposed relation and having a friction liner therebetween, and Belleville spring-loaded bolt means pivotally securing said other ends together whereby said spring is adapted to exert substantially the same restraining force during a substantial portion of the life of said liner.

2. The structure of claim 1 in which a plurality of substantially identical Belleville springs are mounted on said bolt means, said springs being arranged in series to provide a restraining force equal to that of an individual spring but a deflection equal to that provided by an individual spring multiplied by the number of springs in said plurality.

3. The structure of claim 1 in which a plurality of substantially identical Belleville springs are mounted in parallel to provide a deflection equal to that of an individual spring but a restraining force equal to that provided by an individual spring multiplied by the number of springs in said plurality.

4. The structure of claim 1 in which a plurality of identical Belleville springs are mounted on said bolt means, said springs being arranged in at least two sets with the springs in each set being arranged in parallel and with the sets being arranged in series.

5. The structure of claim 1 in which a link is interconnected between said door and said second arm first end.

6. The structure of claim 1 in which one of said arms includes at least two parallel arm portions straddling the other of said arms with friction liners therebetween, aligned openings in said arms to provide a pivot axis, said bolt means extending through said aligned openings.

7. The structure of claim 6 in which said openings are sized to receive said springs therein when the same are ensleeved on said bolt means, and a collar mounted on each end of said bolt means bearing against one of said arms, at least one of said collars having a central recess in which said springs are received.

8. The structure of claim 7 in which both of said collars have central recesses with springs being received in each recess.

9. The structure of claim 6 in which each spring has a height to thickness ratio of the order of 1.25–1.50 to provide a restraining force of at least about 75% at a deflection of about 50%.

* * * * *